US008189828B2

(12) United States Patent
Takumai

(10) Patent No.: US 8,189,828 B2
(45) Date of Patent: May 29, 2012

(54) AUDIO DEVICE AND SOUND BEAM CONTROL METHOD

(75) Inventor: Susumu Takumai, Hamamatsu (JP)

(73) Assignee: Yamaha Corporation (JP)

( * ) Notice: Subject to any disclaimer, the term of this patent is extended or adjusted under 35 U.S.C. 154(b) by 1186 days.

(21) Appl. No.: 11/915,951

(22) PCT Filed: Jun. 2, 2006

(86) PCT No.: PCT/JP2006/311059

§ 371 (c)(1),
(2), (4) Date: Nov. 29, 2007

(87) PCT Pub. No.: WO2006/132136

PCT Pub. Date: Dec. 14, 2006

(65) Prior Publication Data

US 2009/0034763 A1 Feb. 5, 2009

(30) Foreign Application Priority Data

Jun. 6, 2005 (JP) ..... 2005-166230

(51) Int. Cl.
*H04R 5/02* (2006.01)

(52) U.S. Cl. ..... 381/310

(58) Field of Classification Search ..... 381/310
See application file for complete search history.

(56) References Cited

U.S. PATENT DOCUMENTS 3,308,237 A 3/1967 Novak
5,555,306 A * 9/1996 Gerzon ..... 381/63
5,763,785 A * 6/1998 Chiang ..... 73/609
7,515,719 B2 * 4/2009 Hooley et al. ..... 381/18
7,577,260 B1 8/2009 Hooley et al.
2001/0007591 A1 * 7/2001 Pompei ..... 381/111
2004/0151325 A1 * 8/2004 Hooley et al. ..... 381/18
2004/0240697 A1 12/2004 Keele, Jr.
2004/0252844 A1 * 12/2004 Christensen et al. ..... 381/17
2004/0264707 A1 * 12/2004 Yang et al. ..... 381/77

(Continued)

FOREIGN PATENT DOCUMENTS

JP 10-234094 A 9/1998

(Continued)

OTHER PUBLICATIONS

Extended European Search Report issued in corresponding European Patent Application No. 06747103.7 dated Nov. 24, 2010.

(Continued)

*Primary Examiner* — Lincoln Donovan
*Assistant Examiner* — Alexander Talpalatskiy
(74) *Attorney, Agent, or Firm* — Rossi, Kimms & McDowell LLP

(57) ABSTRACT

In an audio device equipped with a speaker array device aligning a plurality of speaker units, a sound beam is emitted towards a specific person in a main beam direction, thus realizing the listening of the audio contents with good sound quality. Other persons listen to the audio contents at off-beam positions; hence, leaked sound due to side lobes of the sound beam is transmitted to them with respect to an intermediate band and a low band, thus realizing the listening of the sound with an adequate volume. A high band is subjected to sharp beam control, wherein with respect to an intermediate volume or higher volume, high-frequency components are convoluted with the sound beam and are emitted with non-directivity.

4 Claims, 7 Drawing Sheets

U.S. PATENT DOCUMENTS

| | | | | |
|---|---|---|---|---|
| 2005/0041530 | A1* | 2/2005 | Goudie et al. | 367/138 |
| 2005/0100171 | A1* | 5/2005 | Reilly et al. | 381/63 |
| 2006/0126878 | A1* | 6/2006 | Takumai et al. | 381/335 |
| 2006/0204022 | A1* | 9/2006 | Hooley et al. | 381/117 |
| 2009/0296954 | A1 | 12/2009 | Hooley et al. | |
| 2010/0104117 | A1 | 4/2010 | Keele, Jr. | |

FOREIGN PATENT DOCUMENTS

| | | | |
|---|---|---|---|
| JP | 2004-363697 | A | 12/2004 |
| WO | 01/23104 | A2 | 4/2001 |
| WO | WO 2004075601 | A1 * | 9/2004 |

OTHER PUBLICATIONS

Search Report issued in corresponding application PCT/JP2006/311059, dated Sep. 12, 2006.

"Mimimoto-kun ∞ mild in ears", which can be retrieved online via the Internet: URL: http://home.s00.itoscom.net/large/CS-30P/, p. 2.

Yamaha News Release; which can be retrieved online via the Internet:URL:http://www.yamaha.co.jp/news/2004/04111601.html, p. 7.

* cited by examiner (A)

(B)

(A)

(B)

AUDIO DEVICE AND SOUND BEAM CONTROL METHOD

This application is a U.S. National Phase Application of PCT International Application PCT/JP2006/311059 filed on Jun. 2, 2006 which is based on and claims priority from JP 2005-166230 filed on Jun. 6, 2005, the contents of which are incorporated herein in its entirety by reference.

TECHNICAL FIELD

The present invention relates to audio devices using speaker arrays, and in particular to sound beam control methods in which sound beams having prescribed directivities are generated in response to audio signals and are controlled in directivities.

The present application claims priority based on Japanese Patent Application No. 2005-166230 filed on Jun. 6, 2005, the contents of which are incorporated herein by reference.

BACKGROUND ART

At present, people living in cities of industrialized countries have enjoyed a variety of life styles and have acted in various time cycles. Accompanied with increasing population, housings have been concentrated in cities in particular; hence, there is a tendency that noise pollution increases not only with respect to inmate family members but with respect to surrounding people. For example, when a viewer watches and listens to an audio-visual device (e.g., a television receiver) so as to generate a relatively large volume of sound in the night, noise pollution occurs which can cause annoyance for other persons other than the viewer. In terms of the protection of privacy of people, it is necessary to reduce the noise pollution.

Until now, a viewer may pay attention to avoid causing noise pollution to the neighboring persons by reducing sound volume; however, when sound volume is simply reduced, there is a disadvantage in that it may be difficult to hear the audio contents (or programs).

When a viewer is at a place distanced from an audio-visual device (e.g., a kitchen distanced from a living room), or when an aged person having poor hearing watches and listens to an audio-visual device, it is necessary to adequately increase the sound volume. However, when a viewer at a surrounding position of the audio-visual device or a viewer having adequate hearing watches and listens to the same contents (or programs) together with the others, there is a problem in that discomfort may occur by the increasing sound volume. In addition, increasing the sound volume may cause noise pollution with respect to inmate family members having no intention to watch and listen to the contents (or programs) and with respect to neighboring persons.

In order to solve the aforementioned problems, local speaker amplifiers arranged in the surrounding areas of specific viewers are put to practical use (see Non-patent document 1). Non-patent document 1: "Mimimoto-kun α mild in ears", which can be retrieved online via the Internet: URL: http://home.s00.itscom.net/large/CS-30P/.

However, the device disclosed in the Non-patent document 1 is constituted using an amplifier speaker (or an earphone) arranged in the surrounding area of a specific viewer; hence, it is necessary to connect the device with a television receiver via a cable. Thus, the cable and amplifier speaker may cause disturbance and are troublesome to set up.

DISCLOSURE OF INVENTION

Problems to be Solved by the Invention

It is an object of the present invention to provide an audio device and a sound beam control method, which allow all the viewers at a surrounding area of an audio-visual device, viewers distanced from it, and viewers having poor hearing, to listen to the same audio contents with the same sound volume and the same sound quality without arranging another speaker in the surrounding area of a specific viewer.

Means for Solving the Problems

In a first aspect of the invention, an audio device includes a speaker array aligning a plurality of speaker units, a sound volume control for controlling input audio signals in volume, a main processing section for controlling timings of supplying the audio signals to the speaker units of the speaker array, so that the speaker array outputs at least one sound beam emitted in a prescribed direction, a high-band control for controlling high-frequency components included in the audio signals to be emitted with directivity characteristics distributed in a broad range, thus supplying the audio signals to the speaker array, and a control section for controlling the output level of the high-band control in response to the volume of the audio signals and/or an emission direction of the sound beam.

In a second aspect of the invention, an audio device includes a speaker array aligning a plurality of speaker units, a sound volume control for controlling input audio signals in volume, and an audio signal processing section for performing processing on the audio signals independently with respect to the speaker units so that the speaker array outputs at least one sound beam. Due to delay processing on audio signals in the audio signal processing section, the sound beam reaches a focal position at the prescribed timing; and it applies a window function, by which the sound volume gradually decreases from the center portion to both ends of the speaker array, to audio signals, wherein the weight of window function being applied is controlled in response to the sound volume.

In a third aspect of the invention, there is provided a beam control method adapted to an audio device equipped with a speaker array aligning a plurality of speaker units, wherein input audio signals are controlled in volume; the timings of supplying audio signals to the speaker units are controlled so that the speaker array outputs at least one sound beam emitted in the prescribed direction; and audio signals are supplied to the speaker array at the level suited to the sound volume and/or the direction of the sound beam, thus emitting audio signals with directivity characteristics by which high-frequency components included in audio signals are distributed in a broad range.

In a fourth aspect of the invention, there is provided a beam control method adapted to an audio device equipped with a speaker array aligning a plurality of speaker units, wherein input audio signals are controlled in volume; processing is performed on audio signals independently with respect to the speaker units so that the speaker array outputs at least one sound beam; delay control is performed on audio signals so that the sound beam reaches a focal position at the prescribed timing; and a window function, in which the sound volume gradually decreases from the center portion to both ends of the speaker array, is applied to audio signals in such a way that the weight of the window function being applied is controlled in response to the sound volume.

Effect of the Invention

In the present invention, when the user of an audio device listens to the audio contents alone, it is possible to set up it so as to reduce leaked sound. While plural persons listen to the same audio contents, even when a specific person therein is distanced from a speaker array device, or even when a specific person therein is an aged person having poor hearing, it is possible to transmit sound to the specific person with a large sound volume (or a high sound pressure), and it is possible to transmit sound to the other persons with a normal sound volume and a normal sound quality.

DESCRIPTION OF THE REFERENCE NUMERALS

Figure 1:
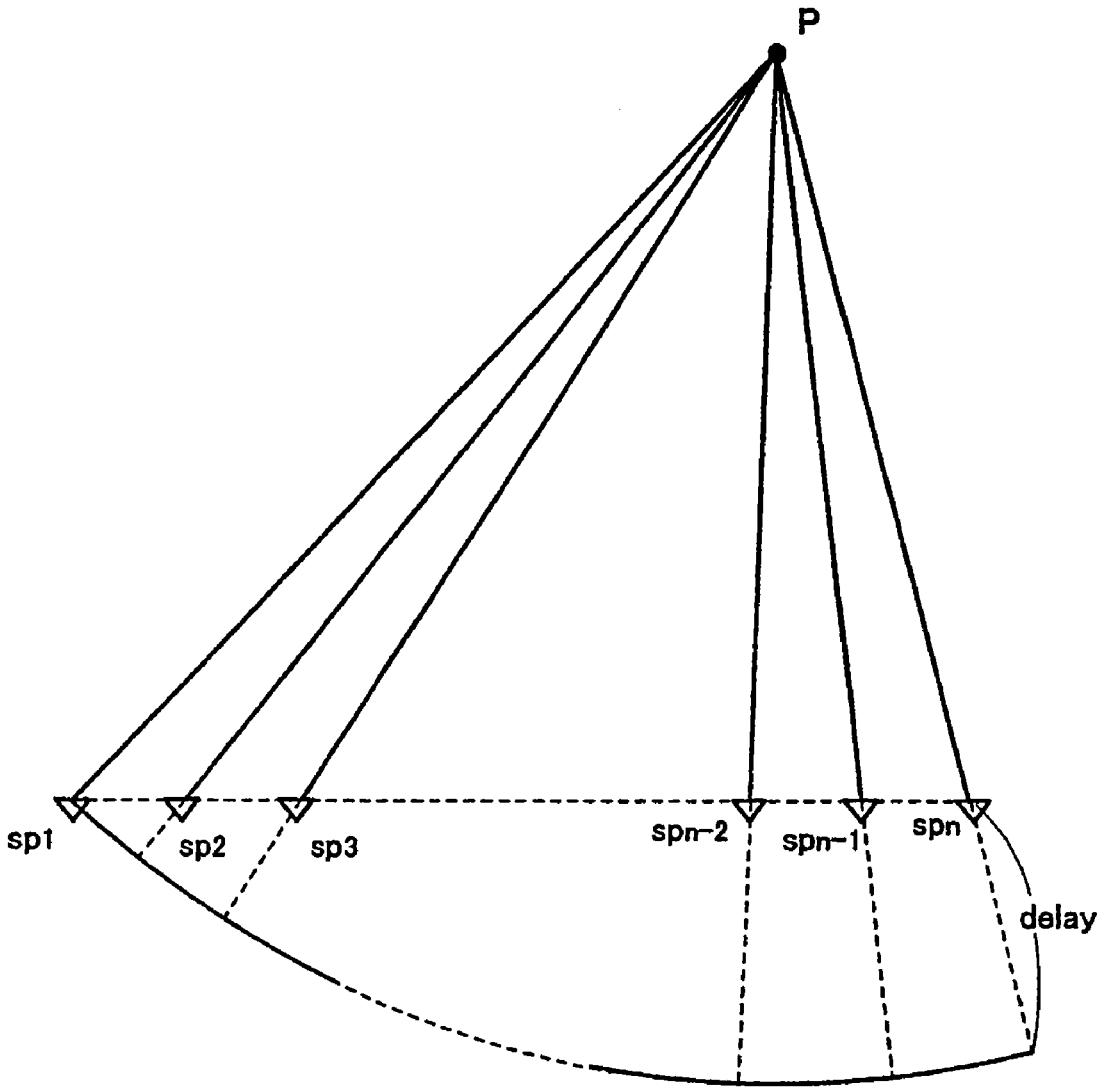
FIG. 1 A drawing for use in the explanation of a sound beam forming method using a speaker array device.

1 Audio device
2 Speaker array
3 Television receiver (display)
4 Infrared remote control
10 Control
11 Tuner
13 Video signal processing
12 Audio signal processing
21 Main volume
22 Beam processing
23 Adder
24 Power amplifier
25 High-pass filter
26 Sound volume control
27 Beam processing

BEST MODE FOR CARRYING OUT THE INVENTION (Explanation of Sound Beam)

An audio device according to a preferred embodiment of the present invention will be described with reference to the accompanied drawings. This audio device can be connected to an audio-visual device such as a television receiver, or the audio device can be used independently.

The audio device of the present invention is equipped with a speaker array device. FIG. 1 is a drawing for use in the explanation of a sound beam forming method using the speaker array device. The speaker array device is an alignment of plural speaker units in a horizontal direction. Suppose that the speaker array device is formed by aligning forty small-size speakers in three lines (which can be retrieved via the Internet: URL: http://www.yamaha.co.jp/news/2004/04111601.html), for example. Each of the speaker units is supplied with the same audio signal, whereas the supply timing and sound volume can be independently controlled with respect to each speaker unit. The output timings (i.e., delay times) of the speaker units are controlled as shown in FIG. 1. Thus, sound waves propagating in the P direction (focal direction or main beam direction) match each other in terms of phases of sounds emitted from speaker units so as to form sound beams having high sound pressures. As described above, it is possible to reduce the attenuation depending upon the distance by use of sound beams having high sound pressures.

Sound waves output from speaker units are shifted from each other in phases in other directions (i.e., off-beam directions) other than the main beam direction, so that they cancel each other and are damped, and they are thus reduced in sound pressure.

That is, the sound beam is formed to allow a clear sound having a high sound pressure to be transmitted in the main beam direction while the sound pressure is suppressed in the off-beam direction so as to realize the transmission of a low-level leaked sound only.

Figure 5:
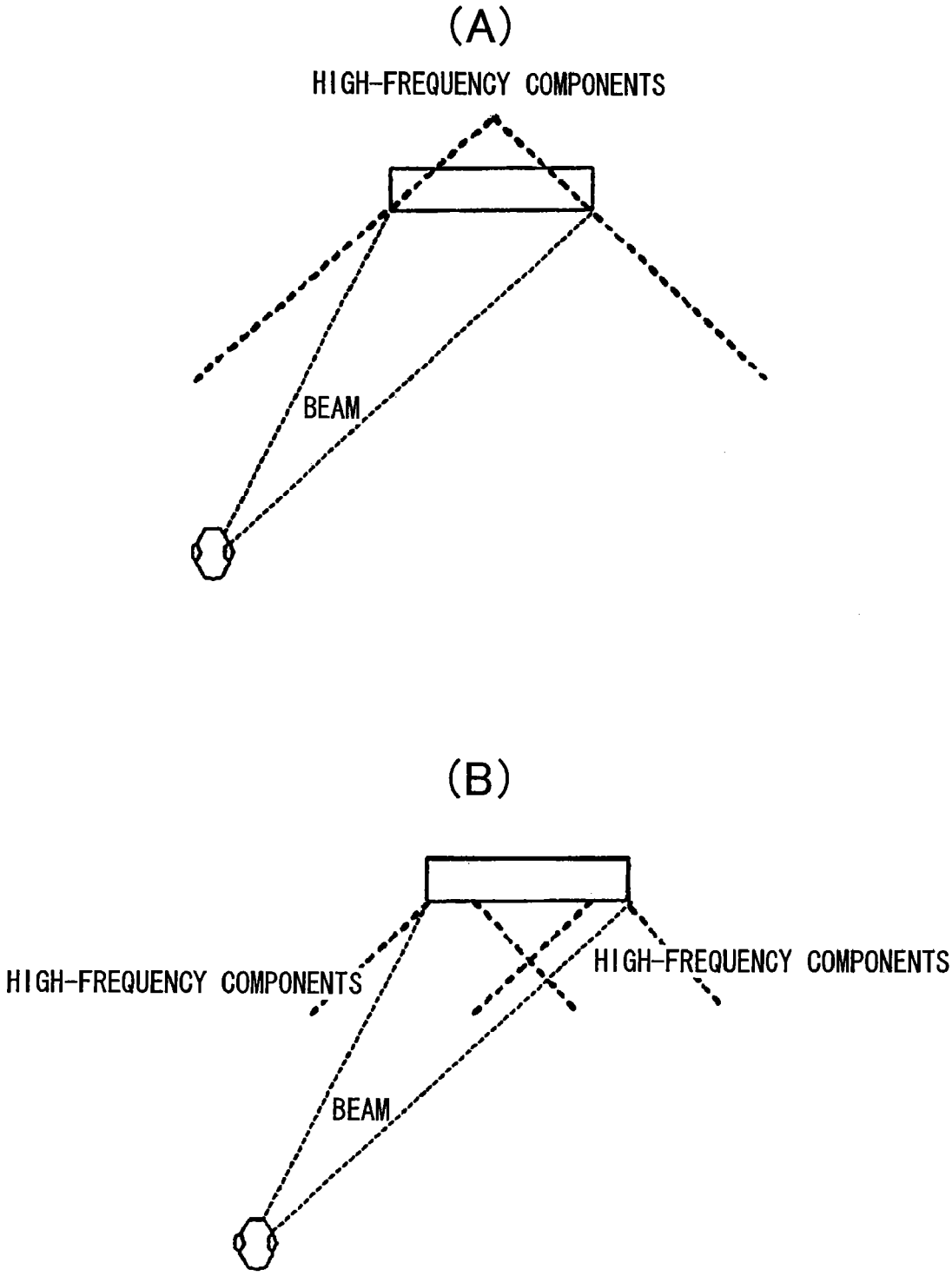
FIG. 5(A): A drawing showing beam control for outputting a sound beam having non-directivity by use of the speaker array device, (B): A drawing showing that the speaker array device outputs high-frequency components only without performing beam control.

Since a focal point is set to the rear side of the speaker array device so as to perform delay control as shown in FIG. 5(A), it is possible to output audio signals with broad directivity characteristics (or non-directivity).

Figure 2:
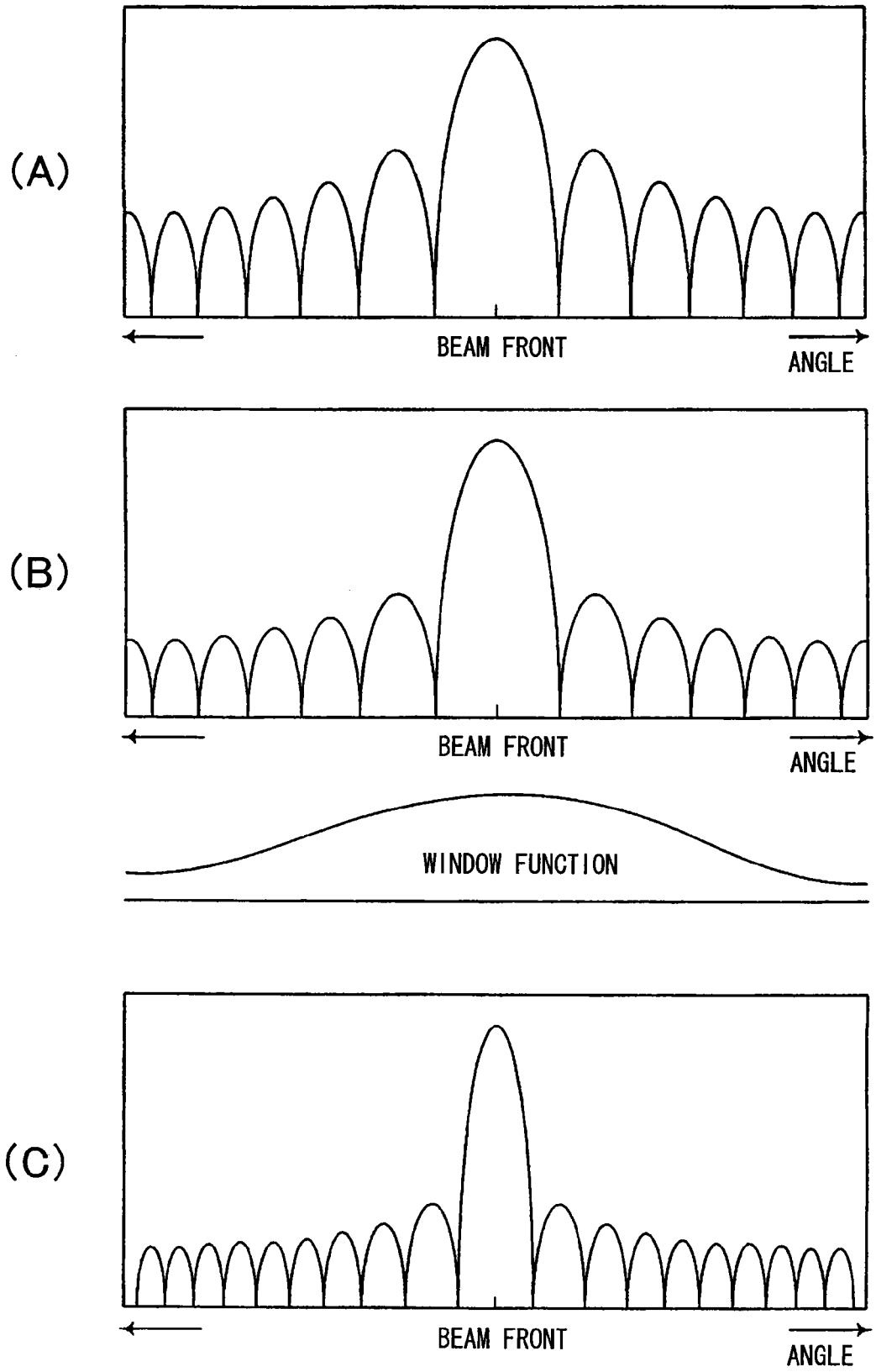
FIG. 2(A): A graph showing the characteristics of the sound beams that are formed by driving the speaker array device based on audio signals subjected to timing control only, (B): A graph showing the characteristics of the sound beams that are formed based on audio signals subjected to sound volume adjustment using a window function, (C): A graph showing high-band beam characteristics.

FIGS. 2(A) to 2(C) show the characteristics (i.e., beam characteristics or sound pressure distribution) of various sound beams formed using the speaker array device. Since the speaker array device has a limited length, sound beams are formed with side lobes. When plural speaker units forming the speaker array device are supplied with audio signals having the same sound volume subjected to timing control, side lobes having relatively high levels occur as shown in FIG. 2(A), and leaked sound having a relatively high volume propagates in the off-beam direction externally of the main beam direction.

When audio signals supplied to plural speaker units included in the speaker array device are adjusted using a window function in volume such that the volume gradually decreases from the center to the both ends of the speaker array device, a high-level main beam is formed in the center of the front face of the speaker array device, while side lobes are reduced smaller in level. This makes it possible to realize the propagation of a low-level leaked sound in the off-beam direction.

Both of FIGS. 2(A) and 2(B) show the beam characteristics of sound beams corresponding to intermediate-band audio signals. FIG. 2(C) shows the beam characteristics of sound beams corresponding to high-band audio signals, which are subjected to beam characteristic control using a window function shown in FIG. 2(B). Audio signals become sharp in beam characteristics as the frequencies thereof increase, while a leaked sound is reduced in level. In addition, a reflected sound on a wall and the like becomes small in level; hence, in a beam control mode, particularly high-band sound components are damped in the off-beam direction.

(Explanation of the Audio Device of the Present Embodiment)

The audio device of the present embodiment uses the aforementioned beam characteristics of the speaker array device so as to allow the user to freely set up and release a beam control mode and to set up a focal position (defined by the main beam direction and distance) of a sound beam by use of a remote control. In addition, the audio device performs the following two sound volume controls in the off-beam direction based on the sound volume set up in the beam control mode under the presumption of the user's utilization manner.

(1) First Case

This is the case for controlling the sound volume to be higher than the intermediate sound volume in the beam control mode. It is presumed that plural persons listen to the audio contents by use of the audio device but a specific person therein is positioned at a kitchen and the like distanced from the audio device or but a specific person therein is an aged person having poor hearing, wherein a sound beam is directed to the specific person while the other persons are positioned in the off-beam direction.

The following processing is performed so as to transmit leaked sounds of the normal volume to the other persons existing in the off-beam direction.

(a) High-frequency components of audio signals are extracted and are additionally output with a non-directivity in the off-beam direction.

(b) Side lobes are increased by reducing the weight of the window function applied to the speaker units. This allows audio signals, in which damping is suppressed with respect to high-frequency components, to be transmitted to the listener who listens to the audio contents in the off-beam direction.

(2) Second Case

This is the case in which the sound volume is controlled to be reduced in the beam control mode. The following processing is performed under the presumption in which a sound beam is set to a single listener in order not to cause trouble to the surrounding others at midnight, for example.

(a) Side lobes are reduced by increasing the weight of the window function applied to the speaker units.

(b) The addition of the aforementioned high-frequency components is stopped.

Due to the beam control, audio signals of a low sound volume can reach the listener with a precise clearness. Due to the low sound volume of audio signals, the leaked sound, which occurs due to side lobes or reflection, does not cause discomfort and does not cause trouble to the surrounding others.

The constitution of the audio device realizing the aforementioned beam control will be described with reference to FIGS. 3(A) and 3(B).

Figure 3:
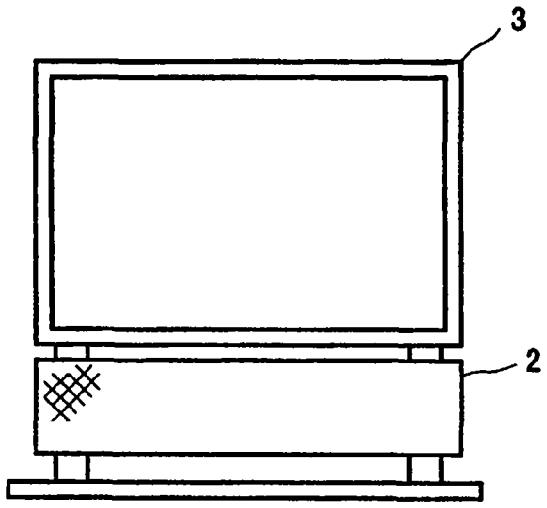
FIG. 3(A): A front view showing the exterior appearance of the system combining an audio device and a television receiver, (B): A block diagram showing the constitution of the system.
Figure 3:
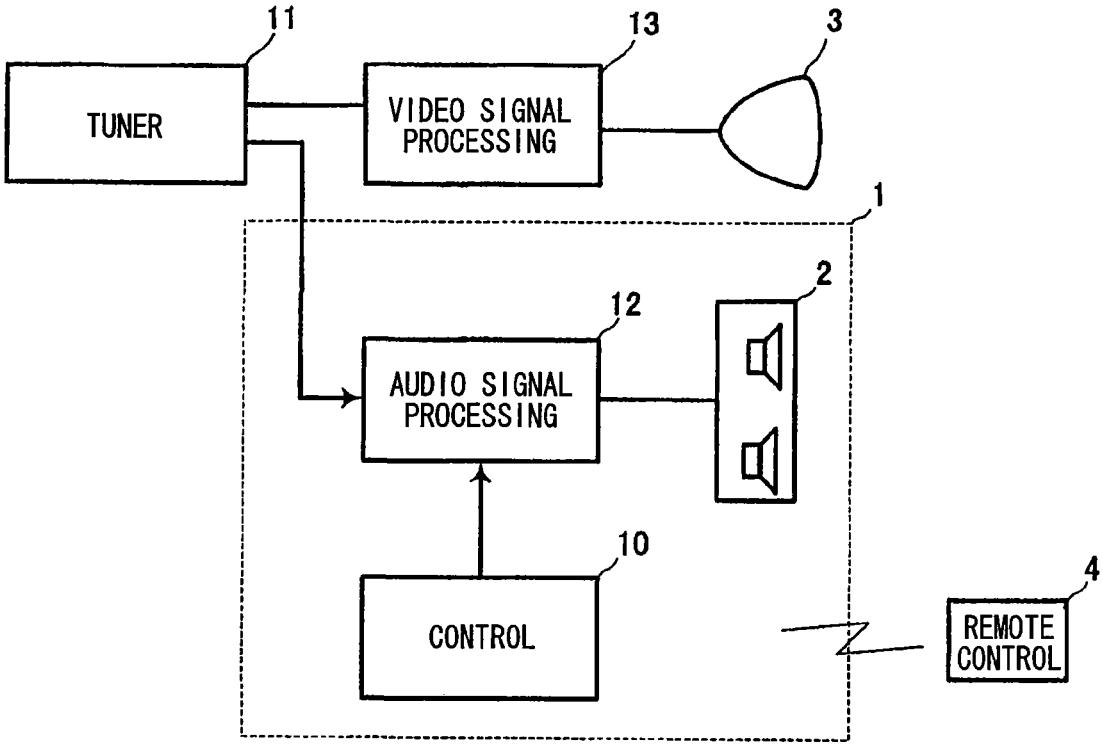

FIG. 3(A) is a front view showing the exterior appearance of the system combining the audio device and the audio-visual device. In this system, the audio device (including a speaker array device 2) is connected to the lower portion of a 42-inch television receiver (including a display 3).

FIG. 3(B) is a block diagram showing the constitution of the system combining the audio device and the television receiver. Herein, a television tuner 11 outputs video signals and audio signals. Video signals are supplied to a video signal processing section 13, in which color signals, luminance signals, and synchronizing signals are isolated and are supplied to the display 3. The display 3 displays a video image based on input signals thereof.

Audio signals are supplied to an audio signal processing section 12 inside of the audio device 1. The audio signal processing section 12 performs sound volume control on audio signals, and it also performs delay control and sound volume control on the speaker units forming the speaker array device 2.

A control section 10 manages the delay control and sound volume control in the audio signal processing section 12. The audio device 1 is equipped with an infrared remote control 4, wherein the user operates the infrared remote control 4 so as to turn on or off the beam control mode, to set up the focal position (defined by the main beam direction and distance), and to designate the sound volume with respect to the control section 10.

Figure 4:
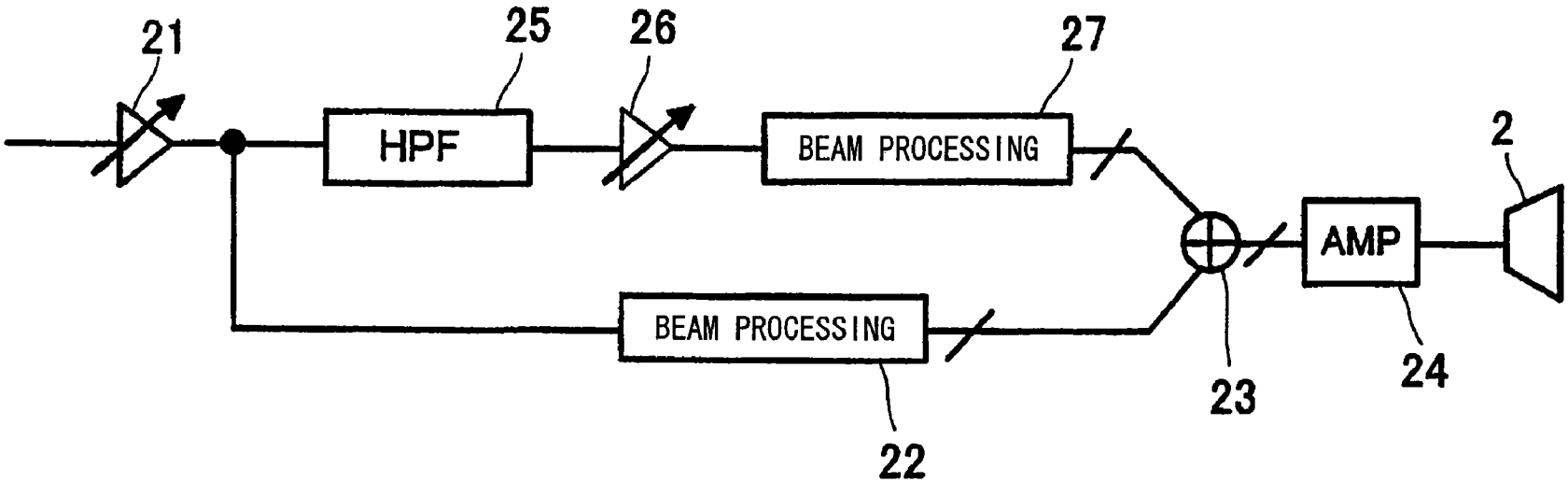
FIG. 4 A block diagram showing the internal constitution of the audio device.

FIG. 4 is a block diagram showing the internal constitution of the audio signal processing section 12. The audio signal processing section 12 can be formed by use of a processing circuit of analog signals or a processor for processing digital signals. In the present embodiment, the audio signal processing section 12 is formed using the processor for processing digital signals. Input audio signals are collectively adjusted in sound volume by means of a main volume 21. Thereafter, audio signals are branched into a main processing section and a sub-processing section (i.e., a high-band control section).

The main processing section performs prescribed processing on audio signals, wherein it includes a beam processing section 22. The beam processing section 22 controls the speaker array device 2 to generate sound beams based on audio signals; alternatively, it controls the timings and volumes of audio signals supplied to the speaker units so as to output sound with non-directivity. For this reason, the beam processing section 22 includes a delay processor and a gain controller independently in correspondence with each of the speaker units. Since the beam processing section 22 controls delay times of audio signals supplied to the speaker units, the speaker array device 2 outputs sound beams towards the focal position P as shown in FIG. 1. When the timing control is performed on audio signals such that delay times decrease in the center portion of the speaker array device 2, it is possible to form a sound beam that is broadened in the front side while forming a focal point in the rear side of the speaker array device 2, thus generating sound with non-directivity.

As described above, audio signals, which are controlled in timing and volume with respect to each of the speaker units, are supplied to each of the speaker units forming the speaker array device 2 via an adder 23 and a power amplifier 24, which are installed in each of the speaker units.

The high-band control section is used to apply high-frequency components in the off-beam direction, wherein it includes a high-pass filter 25, a sound volume controller 26, and a beam processing section 27. The high-pass filter 25 is an active filter that allows the cutoff frequency and the Q factor representing the cutoff steepness to be changed by means of the control section 10, wherein it is set up in response to the beam angle and sound volume. The sound volume controller 26 controls the sound volume of high-frequency audio signals extracted by the high-pass filter 25. The beam processing section 27 has the same constitution as the beam processing section 22 included in the main processing section, wherein it performs delay control and sound volume control (realizing the window function) on high-frequency components, which are controlled in volume, with respect to each of the speaker units, thus supplying the output signals thereof to the adder 23. The adder 23 adds the output signal of the main processing section and the output signal of the high-frequency control section with respect to each of the speaker units.

Incidentally, the high-frequency control section is controlled by the control section 10 in such a way that it operates upon the setup of an intermediate sound volume or more by means of the main volume 21.

As described above, the high-frequency control section outputs audio signals with the directivity characteristics realizing a broad range distribution of high-frequency components or with non-directivity in the off-beam direction. When the speaker array device 2 outputs audio signals with broad-range directivity or non-directivity, the beam processing section 27 is set up to realize the beam distributions shown in FIGS. 5(A) and 5(B).

FIG. 5(A) shows a timing control method, in which a focal point is set in the rear side of the speaker array device 2 so that sound is diffused therefrom, with respect to each of the speaker units. This method performs the timing control in such a way that maximum delay times are applied to the speaker units arranged in both ends of the speaker array device 2, while a substantially zero delay time is applied to the speaker unit positioned in the center portion of the speaker array device 2.

FIG. 5(B) shows a method in which high-frequency components are only output by use of the speaker units forming a part of the speaker array device 2 without performing beam control using the speaker array device 2. In this method, the speaker array device 2 outputs no sound beam, wherein high-frequency components of audio signals are only output with the directivity characteristics solely applied to a prescribed speaker unit.

(Explanation of Addition of High-Frequency Components and Window Function Control)

Figure 6:
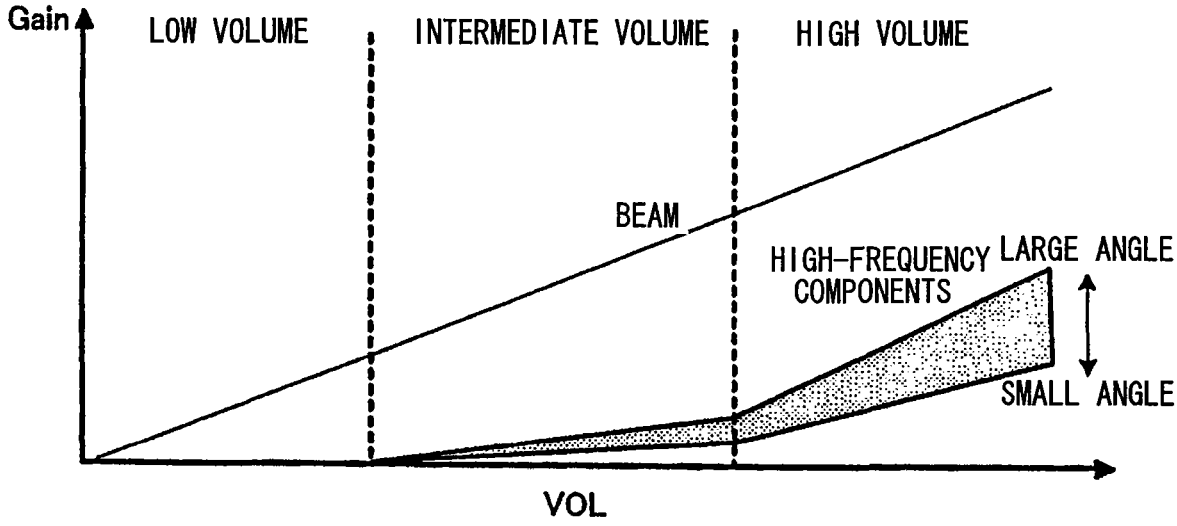
FIG. 6 A graph showing the relationship between beam angles of sound beams emitted from the speaker array device and high-frequency components.

FIG. 6 is a graph for use in the explanation of the addition control of high-frequency components (i.e., the setup control of the sound volume control section 26) in response to the sound volume set to the main volume 21 and the beam angle (i.e., the angle of the emission direction of the sound beam diffused in the front face direction of the speaker array device 2) set to the beam processing section 22 in the main processing section.

When the sound volume is low, high-frequency components are not added to the sound beam emitted from the speaker array device 2. This is because it is presumed that, in the case of low volume, the user of the audio device 1 enjoys the audio contents alone without causing trouble to the surrounding others, wherein it is unnecessary to output audio signals in any directions other than the main beam direction.

In the case of intermediate volume or more, it is presumed that plural persons listen to the same audio contents, and a specific person therein should listen to the sound with a relatively high volume. In this case, it is necessary to set a sound beam to the specific person and to have the other persons listen to the leaked sound emitted in the off-beam direction. Therefore, high-frequency components are added in the off-beam direction so as to emphasize high-frequency components of the leaked sound, thus generating sound having flat characteristics.

In the aforementioned case, when the sound volume is increased, low-frequency components are emphasized, while high-frequency components are weakened. To compensate for it, the amount of high-frequency components being added is increased as shown by the graph of FIG. 6.

When the beam angle is increased, high-frequency components may be extremely damped in the place deviated from the main beam direction; hence, in the case of the large beam angle compared with the case of the small beam angle, the amount of high-frequency components being added is increased.

Figure 7:
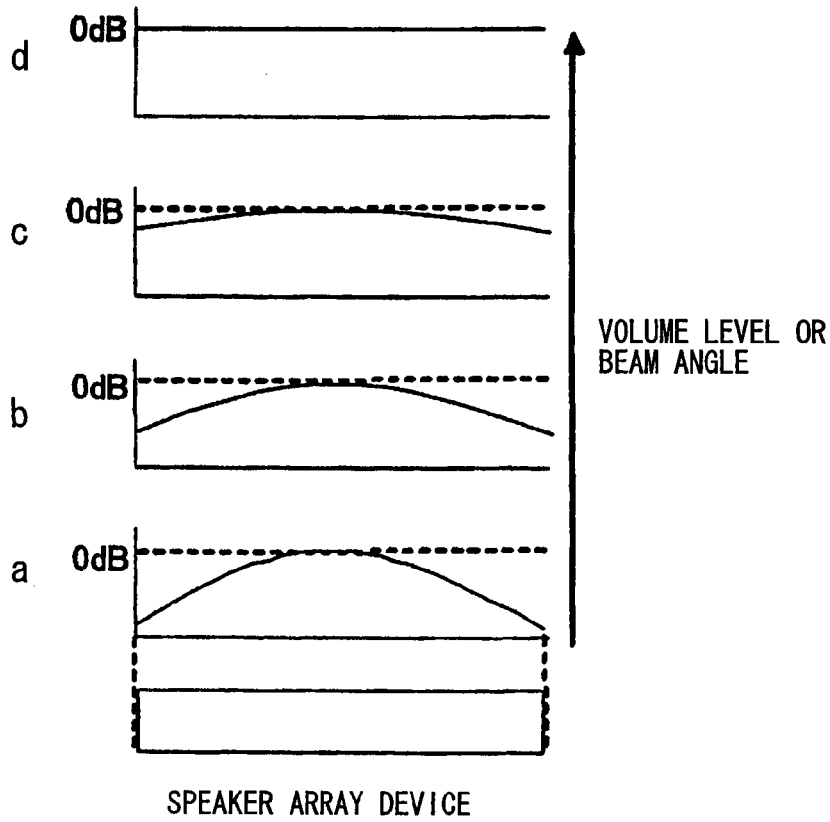
FIG. 7(A): Graphs showing examples of applied window functions in relation to sound volumes and beam angles in beam processing of audio signals, (B): a graph showing the relationship between applied window functions, sound volumes, and beam angles.
Figure 7:
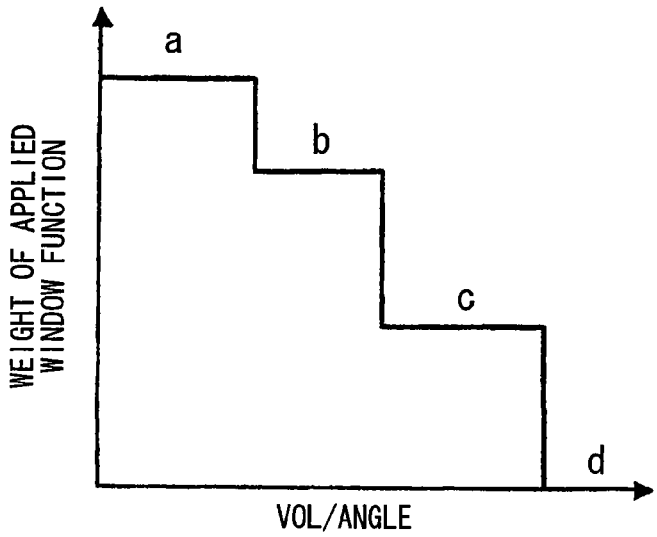

FIGS. 7(A) and 7(B) show a method for controlling the weight of the window function applied to the beam processing section 27 in response to the sound volume set to the main volume 21 and the beam angle set to the beam processing section 22 of the main processing section. That is, the window function, in which the sound volume is gradually decreased from the center portion to both ends of the speaker array, is subjected to weighting between the condition, in which side lobes become minimum, and the condition, in which the window function is not multiplied.

In the case of the low sound volume and the small beam angle, the weight of the window function being applied is increased (see a in FIGS. 7(A) and 7(B)). This makes it possible to extremely reduce the leaked sound in the surroundings. As the sound volume increases, or as the beam angle increases, the weight of the window function being applied is decreased (see b and c in FIGS. 7(A) and 7(B)). In the case of the high sound volume and the large beam angle, audio signals having flat sound volume characteristics are supplied to all the speaker units included in the speaker array device 2 without performing the sound volume control using the window function (see d in FIGS. 7(A) and 7(B)). Thus, side lobes become large, and the sound volume of the leaked sound becomes high.

The present embodiment uses both of the addition control of high-frequency components and the side lobe control using the window function, although it is possible to perform one of them.

The present embodiment automatically sets up the amount of high-frequency components being added and the weight of the window function being added on the basis of the sound volume set to the main volume 21, although it is possible for the user of the audio device to set up the amount of high-frequency components being added and the weight of the window function being added.

In addition, it is possible to control the cutoff frequency of the high-pass filter 25 and the Q factor in response to the sound volume set to the main volume 21 and the beam angle set to the beam processing section 22 of the main processing section.

Since the beam characteristics depend upon the frequencies of audio signals as shown in FIGS. 2(A), 2(B), and 2(C), it is possible to divide audio signals into plural bands and to perform the beam control such that the window function differs with respect to each band. This makes it possible realize the similar beam characteristics with respect to all frequency bands.

INDUSTRIAL APPLICABILITY

The present invention provides an audio device, which performs beam control using an array speaker device, which can be connected to the existing audio-visual device, which can realize listening control on the audio contents with ease, and which can be applied to various audio-visual systems.

The invention claimed is:

1. An audio device comprising:

a speaker array device containing a plurality of speaker units aligned in an array;

a first sound level controller for controlling a sound level of at least one input audio signal;

a high-pass filter for passing only high-frequency components of the audio signal output from the first sound level controller;

a main processing section for controlling supplying timings at which the audio signal output from the first sound level controller is supplied to the speaker units of the speaker array device, so that the speaker array device outputs at least one sound beam emitted in a prescribed direction;

a high-band processing section for controlling the high-frequency components of the audio signal output from the high-pass filter to the speaker units of the speaker array device so that the high-frequency components output from the high-pass filter emit with directivity characteristics distributed in a wide angle; and a second sound level controller for separately controlling an output level of the high-frequency components of the audio signal output from the high-pass filter in response to at least one of the sound level of the audio signal output from the first sound level controller or an emission direction of the sound beam.

2. An audio device comprising:

a speaker array device containing a plurality of speaker units aligned in an array;

a sound level controller for controlling a sound level of at least one input audio signal; and an audio signal processing section for performing processing on the audio signal output by the sound level controller independently with respect to the plurality of speaker units so that the speaker array device outputs at least one sound beam, wherein the audio signal processing section performs delay processing on the audio signal output by the sound level controller so that the sound beam reaches a focal position at a prescribed timing, wherein the audio signal processing section applies a window function to gradually decrease the sound level, from a center portion toward both ends of the speaker array, while maintaining the sound level at the center portion substantially the same as controlled by the sound level controller, and wherein the audio signal processing section applies a different weight of the window function depending on the sound level of the audio signal controlled by the sound level controller to gradually decrease the sound level from the center portion toward the both ends of the speaker array at different rates depending on the sound level of the at least one input audio signal controlled by the sound level controller.

3. A beam control method for an audio device equipped with a speaker array device containing a plurality of speaker units aligned in an array, the audio device having a first sound level controller, a second sound level controller, a high-pass filter, a main processing section, and a high-band processing section, the beam control method comprising the steps of:

controlling, with the first sound level controller, a sound level of at least one input audio signals;

extracting, with the high-pass filter, only high-frequency components from the audio signal output from the first sound level controller;

controlling, with the main processing section, supplying timings, at which the audio signal output from the first sound level controller is supplied to the speaker units, so that the speaker array device outputs at least one sound beam emitted in a prescribed direction;

controlling, with the high-band processing section, the high-frequency components of the audio signal output from the high-pass filter to the speaker units of the speaker array device so that the high-frequency components emit with directivity characteristics distributed at a wide angle; and separately controlling, with the second sound level controller, an output level of the high-frequency components of the audio signal output from the high-pass filter in response to at least one of the level of the input audio signal controlled with the first sound level controller or an emission direction of the sound beam.

4. A beam control method adapted to an audio device equipped with a speaker array device containing a plurality of speaker units aligned in an array, the beam control method comprising the steps of:

controlling a sound level of at least one input audio signal;

performing processing on the audio signal controlled in the sound level controlling step independently with respect to the plurality of speaker units so that the speaker array device outputs at least one sound beam;

performing delay control on the audio signal processed by the audio signal processing step so that the sound beam reaches a focal position at a prescribed timing;

applying a window function so that a sound level gradually decreases, from a center portion toward both ends of the speaker array, while maintaining the sound level at the center portion substantially the same as controlled in the sound level controlling step, wherein the window function applying step applies a different weight of the window function to gradually decrease the sound level from the center portion toward the both ends of the speaker array device at different rates depending on the sound level of the at least one input audio signal controlled in the sound level controlling step.

* * * * *